US006367516B1

(12) United States Patent
Christman et al.

(10) Patent No.: US 6,367,516 B1
(45) Date of Patent: Apr. 9, 2002

(54) METHOD OF PROVIDING AUTOMATED REMOTE CONTROL OF THE OPERATION OF MULTIPLE REFUELING STATIONS

(75) Inventors: Gary L. Christman; William Goggin, both of Fort Wayne, IN (US)

(73) Assignee: Tokheim Corporation, Fort Wayne, IN (US)

( * ) Notice: Subject to any disclaimer, the term of this patent is extended or adjusted under 35 U.S.C. 154(b) by 0 days.

(21) Appl. No.: 09/296,830

(22) Filed: Apr. 22, 1999

Related U.S. Application Data

(63) Continuation-in-part of application No. 09/218,516, filed on Dec. 22, 1998.

(51) Int. Cl.[7] ..... B65B 1/00

(52) U.S. Cl. ..... 141/1; 141/94; 141/98; 141/231; 705/413; 700/232; 700/236

(58) Field of Search ..... 141/1, 94, 98, 141/231; 705/413; 700/231, 232, 236, 237, 282, 283

(56) References Cited

U.S. PATENT DOCUMENTS

| | | | | | |
|---|---|---|---|---|---|
| 3,642,036 | A | | 2/1972 | Ginsburgh et al. | 141/94 |
| 4,111,282 | A | | 9/1978 | Vayda, Jr. | 141/98 |
| 4,263,945 | A | | 4/1981 | Van Ness | |
| 4,681,144 | A | * | 7/1987 | Horvath et al. | 141/94 |
| 4,881,581 | A | | 11/1989 | Hollerback | |
| 5,156,198 | A | | 10/1992 | Hall | |
| 5,383,500 | A | | 1/1995 | Dwars et al. | 141/98 |
| 5,605,182 | A | | 2/1997 | Oberrecht et al. | |
| 5,609,190 | A | * | 3/1997 | Anderson et al. | 141/94 |
| 5,612,890 | A | * | 3/1997 | Strasser et al. | 700/236 |
| 5,628,351 | A | | 5/1997 | Ramsey, Jr. et al. | |
| 5,634,503 | A | | 6/1997 | Musil et al. | |
| 5,671,786 | A | | 9/1997 | Corfitsen | |
| 5,719,779 | A | | 2/1998 | Shuler et al. | |
| 5,727,608 | A | | 3/1998 | Nusbaumer et al. | |
| 6,000,832 | A | * | 12/1999 | Franklin et al | 700/232 |

* cited by examiner

*Primary Examiner*—J. Casimer Jacyna
(74) *Attorney, Agent, or Firm*—Randall J. Knuth

(57) ABSTRACT

A central system controller located at a remote service facility performs the centralized processing of the various refueling transaction requests originating from a network of service station sites. The transaction request is transmitted by the customer from a vehicle RF transceiver to a dispenser equipped RF transceiver where it is routed through an on-site dedicated controller to the central system controller over a long-haul communications link. The central system controller processes the transaction and directs the dedicated controller to render operative control of the fuel dispenser and an associated hydraulic arm assembly that selectively maneuvers the nozzle assembly into fueling engagement with the vehicle in an automated fashion. The central system controller is connected to other commercial retailers such as online merchants to permit the customer to request additional transactions unrelated to the refueling activity.

12 Claims, 6 Drawing Sheets

METHOD OF PROVIDING AUTOMATED REMOTE CONTROL OF THE OPERATION OF MULTIPLE REFUELING STATIONS

CROSS-REFERENCE TO RELATED APPLICATIONS

This application is a continuation-in-part of U.S. patent application Ser. No. 09/218,516 filed Dec. 22, 1998, still pending.

This application is related to co-pending application entitled AUTOMATED FUELING SYSTEM WITH REMOTE SERVICE FACILITY TO OPERATE MULTIPLE REFUELING STATIONS by the same inventors as the instant application and assigned to the same assignee as the instant application.

BACKGROUND OF THE INVENTION

1. Field of the Invention

The present invention relates to a system for delivering fuel and more particularly to an automated fuel dispensing system that employs a remote control system to centrally supervise and manage the vehicle refueling operations requested by customers located at multiple distributed service station sites.

2. Description of the Related Art

A typical refueling transaction requires the customer to first exit the vehicle and then interact with some type of input device arranged at the fuel dispenser housing area in order to request the refueling operation and indicate the form of payment. One conventional input device utilizes a simple keypunch entry pad that enables the customer to select the type of fuel, the volume of fuel to be dispensed, and any other related billing information. The billing mechanism typically employs an insert-type card slot that reads the relevant customer account information embedded on the magnetic strip. After the transaction request is authorized, the customer is notified of this acceptance and is ordered to commence the refueling operation. The customer would then manually insert the nozzle assembly into the fuel inlet of the vehicle and activate the attached lever mechanism to dispense the fuel. The customer returns the nozzle assembly to its holding receptacle after completing the refueling activity and then retrieves the billing receipt being printed at the fuel dispenser housing.

Authorization of the refueling request typically involves transmission of the credit card information to the card issuer to verify that sufficient funds are available for the transaction. The refueling request is either approved or denied based upon the response received in connection with the verification inquiry. The fuel dispensing apparatus is appropriately operated pursuant to the decision made regarding the refueling request. For purposes of implementing these transaction processing functions, service station sites are conventionally provided with on-site processing facilities to request verification of the credit card account (i.e., by communicating with the card issuing institution) and then executing the proper course of control action relative to the fuel dispensing equipment based on the verification response. The control facility for processing the transaction request is typically implemented by processor devices and other such equipment located at the service station site. What is apparent from this arrangement is that the processing functions associated with making a decision regarding the transaction request and then formulating the proper control action to implement the decision are localized to the particular service station site where the refueling operation takes place. This form of dedicated on-site processing may be appropriate for franchises having only a few local service station outlets, but for larger entities having networks of franchises distributed throughout the world this type of processing arrangement is inefficient and not cost effective due to the redundant configuration of equipment and labor associated with each service station site.

What is therefore needed is some form of centralized system controller that can manage the entire portfolio of refueling requests that are generated at multiple service station sites distributed throughout a large service area. The centralized system controller should not be location-dependent but can be configured at any remote service facility deemed suitable for this purpose. Additionally, the fuel delivery system that incorporates this centralized system controller should execute the refueling operation in an automated manner so as to eliminate any customer involvement with the fuel dispensing apparatus and thereby permit the customer to remain in the vehicle throughout the entire refueling period.

SUMMARY OF THE INVENTION

According to the present invention there is provided an automated fuel delivery method and system for managing the plurality of refueling transaction requests that are generated by a plurality of fuel dispensing systems arranged at a plurality of service station sites. Integrated with each fuel dispensing assembly is a respective dedicated control system that includes a controller, an RF transceiver, a robotic actuator assembly for selectively maneuvering the fuel dispensing nozzle assembly into fuel dispensing engagement with the vehicle fuel inlet, and a camera-based monitoring assembly mounted to the robot to provide video signals to assist in the robotic maneuvering activity. The vehicle for refueling is equipped with an RF transceiver that is arranged for communication with the RF transceiver associated with the dedicated control system. Each one of the dedicated control systems configured at each one of the service station sites is arranged for communication with a central system controller located at a remote service facility. The central system controller performs centralized processing of the refueling transaction requests received from the service station sites. In this manner, the transaction requests for all of the service station sites are processed in a centralized manner at the remote service facility. The appropriate control activity responsive to each transaction request is generated according to the relevant transaction processing results and then transmitted to the dedicated control system in the form of suitable control commands, where the associated controller then properly operates the robotic arm and the fuel dispenser in accordance with the control commands. The customer can request additional transactions other than the refueling request since the central system controller is arranged for connection to a communications network that provides access to other commercial retailers, e.g., online merchants having electronic commerce sites on the Internet and Worldwide Web.

The invention, in one form thereof, comprises a method of delivering fuel to a vehicle positioned at a service station site, such service station site including a fuel dispensing assembly arranged to operatively provide fuel to the vehicle and having a nozzle assembly. The method comprises, in combination, the steps of: providing a remote system controller disposed remote from the service station site; generating at the service station site information relating to a refueling transaction request associated with the vehicle;

transmitting the generated information from the service station site to the remote system controller; such remote system controller operatively performing the steps of processing the refueling transaction request associated with the information received from the service station site and generating control commands based on the processing activity for the refueling transaction request, such generated control commands being representative of a selectable refueling operation for the vehicle; placing the nozzle assembly of the fuel dispensing assembly into a selective one of engagement and disengagement with respect to a fuel inlet of the vehicle in accordance with the control commands generated by the remote system controller; and operating the fuel dispensing assembly in accordance with the control commands generated by the remote system controller.

The information generation step further comprises the steps of: providing a first wireless communications device in integral association with the vehicle, such first wireless communications device being operatively activatable by a refueling customer associated with the vehicle; and providing a second wireless communications device being disposed at the service station site in a manner sufficient to enable operative communications with the first wireless communications device while the vehicle is positioned for refueling relative to the fuel dispensing assembly. The operative communications between the first wireless communications device and the second wireless communications device includes the information relating to the refueling transaction request.

The nozzle assembly placement step further comprises the steps of: providing an actuator assembly operatively associated with the fuel dispensing assembly, such actuator assembly being operative in response to suitable control commands applied thereto to selectively cause the nozzle assembly to be placed into a selective one of mating fueling engagement with the vehicle fuel inlet and disengagement from the vehicle fuel inlet; and operating the actuator assembly in accordance with the control commands generated by the remote system controller.

The information transmission step further comprises the steps of: providing a dedicated controller operatively connected to the fuel dispensing assembly, actuator assembly, and second wireless communications device; such dedicated controller being operative to control the dispensing of fuel by the fuel dispensing assembly, to control the operation of the actuator assembly, and to transmit to the remote system controller information relating to the refueling transaction request provided by the first wireless communications device to the second wireless communications device.

The method, in one form thereof, further comprises the step of providing a communications link to operatively connect the remote system controller with the dedicated controller.

The remote system controller, in one form thereof, further performs the step of issuing the control commands generated by the remote system controller to the dedicated controller for conducting operative control of the fuel dispensing assembly by the dedicated controller and operative control of the actuator assembly by the dedicated controller in accordance with the issued control commands.

The method, in one form thereof, further comprises the step of generating position signals representative of the position of the actuator assembly relative to the vehicle and relative to the nozzle assembly. The position signal generation step further includes the steps of generating video signals representative of the positional relationship of the actuator assembly relative to the vehicle and relative to the nozzle assembly; and providing the generated video signals to the dedicated controller. The dedicated controller is further operative to transmit to the remote system controller the generated video signals provided thereto and data signals provided thereto by the fuel dispensing assembly being representative of an operational state of the fuel dispensing assembly.

The remote system controller, in another form thereof, further performs the steps of: (a) evaluating the information received from the dedicated controller to make a decision regarding a selective one of approval and denial of the refueling transaction request, generating dispenser control signals based on the evaluation of the information and developed in accordance with the refueling decision, such generated dispenser control signals being representative of a selectable refueling activity for the fuel dispensing assembly, and transmitting the generated dispenser control signals to the dedicated controller for operative control action in accordance therewith; (b) evaluating the video signals received from the dedicated controller, generating actuator assembly control signals based on the video signals evaluation, such generated actuator assembly control signals being representative of an operational repositioning activity for the actuator assembly relative to maneuvering the nozzle assembly into a selective one of engagement and disengagement relative to the fuel inlet of the vehicle, and transmitting the generated actuator assembly control signals to the dedicated controller for operative control action in accordance therewith; and (c) evaluating the fuel dispensing assembly data signals received from the dedicated controller to determine if the selected refueling activity has been completed, and, upon an affirmative determination of the completion of refueling activity, transmitting to the dedicated controller control signals sufficient to operate the actuator assembly to cause the disengagement of the nozzle assembly from the fuel inlet of the vehicle.

The method, in another form thereof, further comprises the steps of: providing a communications network operatively connected to the remote system controller, such communications network being arranged to provide communications access to at least one merchant to enable the execution of a transaction therewith by the remote system controller in accordance with an associated transaction request operatively transmitted from the service station site to the remote system controller. The method further includes the steps of: generating at the service station site a commercial transaction request relating to commercial activity involving a selective one of the at least one merchant; and transmitting the generated commercial transaction request to the remote system controller; such remote system controller performing the steps of processing the commercial transaction request transmitted thereto and conducting a transaction with the corresponding one of the at least one merchant associated with the commercial transaction request in accordance with the processing activity for the commercial transaction request.

The step of providing a communications network further includes the step of providing an internet facility including a respective electronic commerce site for each one of the at least one merchant that enables the operative processing of transaction requests characterized by electronic commerce activity.

The invention, in another form thereof, comprises a method of delivering fuel to a vehicle positioned at a service station site, such service station site including a fuel dispensing assembly arranged to operatively provide fuel to the vehicle and having a nozzle assembly. The method comprises, in combination, the steps of: providing an actuator assembly operatively associated with the fuel dispensing assembly, such actuator assembly being operative in response to suitable control commands applied thereto to controllably cause the nozzle assembly to be placed into a selective one of mating fueling engagement with the vehicle fuel inlet and disengagement from the vehicle fuel inlet; providing a control assembly operatively connected to the fuel dispensing assembly and operatively connected to the actuator assembly; wirelessly transmitting from the vehicle to the control assembly information relating to a refueling transaction request associated with the vehicle; providing a remote operations facility disposed remote from the service station site; transmitting from the control assembly to the remote operations facility the information wirelessly transmitted to the control assembly; such remote operations facility performing the steps of processing the information received from the control assembly to make a refueling decision regarding a selective one of approval and denial of the refueling transaction request, generating control commands based on the information processing activity, and transmitting the generated control commands to the control assembly, such generated control commands being representative of a selectable refueling operation for the vehicle; and such control assembly operatively controlling the operation of the actuator assembly and the operation of the fuel dispensing assembly in accordance with the control commands received from the remote operations facility.

The wireless information transmission step further comprises the steps of: providing a first wireless communications device integral with the vehicle and having at least one of a transmit capability and a receive capability; and operatively activating the first wireless communications device to establish operative communications with the control assembly. The operative communications between the first wireless communications device and the control assembly includes information relating to the refueling transaction request. The operative activation of the first wireless communications device occurs through selective engagement thereof by a customer associated with the vehicle.

The step of providing a control assembly further comprises the steps of: providing a second wireless communications device being disposed at the service station site in a manner sufficient to enable operative communications with the first wireless communications device while the vehicle is positioned for refueling relative to the fuel dispensing assembly.

The method, in one form thereof, further comprises the steps of: providing to the control assembly position signals representative of the position of the actuator assembly relative to the vehicle and relative to the nozzle assembly; and transmitting from the control assembly to the remote operations facility the provided position signals.

The remote operations facility, in one form thereof, further performs the steps of: (a) evaluating the information received from the control assembly to make a decision regarding a selective one of approval and denial of the refueling transaction request, generating dispenser control signals based on the evaluation of the information and developed in accordance with the refueling decision, such generated dispenser control signals being representative of a selectable refueling activity for the fuel dispensing assembly, and transmitting the generated dispenser control signals to the control assembly for operative control action in accordance therewith; (b) evaluating the position signals received from the control assembly, generating actuator assembly control signals based on the position signals evaluation, such generated actuator assembly control signals being representative of an operational repositioning activity for the actuator assembly relative to maneuvering the nozzle assembly into a selective one of engagement and disengagement relative to the fuel inlet of the vehicle, and transmitting the generated actuator assembly control signals to the control assembly for operative control action in accordance therewith; and (c) evaluating data received from the control assembly being representative of an operational state of the fuel dispensing assembly to determine if the selected refueling activity has been completed, and, upon an affirmative determination of the completion of refueling activity, transmitting to the control assembly control signals sufficient to operate the actuator assembly to cause the disengagement of the nozzle assembly from the fuel inlet of the vehicle.

The method, in another form thereof, further comprises the step of providing a communications network operatively connected to the remote operations facility, such communications network being arranged to provide communications access to at least one merchant to enable the execution of a transaction therewith by the remote operations facility in accordance with an associated transaction request operatively received from the control assembly. The method, in another form thereof, further comprises the steps of: transmitting from the first wireless communications device to the second wireless communications device a commercial transaction request relating to commercial activity involving a selective one of the at least one merchant; and transmitting the commercial transaction request received by the second wireless communications device to the remote operations facility; such remote operations facility performing the steps of processing the commercial transaction request transmitted thereto and conducting a transaction with the corresponding one of the at least one merchant associated with the commercial transaction request in accordance with the processing activity for the commercial transaction request.

The step of providing a communications network further includes the step of providing an internet facility including a respective electronic commerce site for each one of the at least one merchant that enables the operative processing of transaction requests characterized by electronic commerce activity.

The invention, in another form thereof, comprises a method of handling a plurality of refueling requests each associated with a respective one of a plurality of vehicles each positioned for refueling at an associated one of a plurality of service station sites, wherein one of the plurality of vehicles is operatively associated with a respective fuel dispensing assembly having a respective nozzle assembly and which is arranged to operatively provide fuel to the vehicle associated therewith. The method comprises, in combination, the steps of: providing a remote operations facility disposed remote from at least one of the plurality of service station sites; and operatively performing the following steps in relation to each respective one of the plurality of refueling transaction requests: generating at the associated service station site respective information relating to the respective one refueling transaction request; transmitting the respective generated information from the associated service station site to the remote operations facility; wherein such remote operations facility operatively performs the steps of processing the respective one refueling transaction request associated with the respective information received from the associated service station site, and generating respective control commands based on the processing activity for the respective one refueling transaction request, such respective generated control commands being representative of a respective selectable refueling operation for the associated vehicle; placing the respective nozzle assembly of the associated fuel dispensing assembly into a selective one of engagement and disengagement with respect to a fuel inlet of the associated vehicle in accordance with the respective control commands generated by the remote operations facility; and operating the associated fuel dispensing assembly in accordance with the respective control commands generated by the remote operations facility.

Each respective information generation step of each respective operative performance step associated with each respective one of the plurality of refueling transaction requests further comprises the steps of: providing a respective first wireless communications device in integral association with the associated vehicle, such respective first wireless communications device being operatively activatable by a refueling customer associated with the vehicle; and providing a respective second wireless communications device being disposed at the associated service station site in a manner sufficient to enable operative communications with the respective first wireless communications device while the associated vehicle is positioned for refueling relative to the associated fuel dispensing assembly. The operative communications between the respective first wireless communications device and the respective second wireless communications device includes information relating to the respective one refueling transaction request.

Each respective nozzle assembly placement step of each respective operative performance step associated with each respective one of the plurality of refueling transaction requests further comprises the steps of: providing a respective actuator assembly operatively associated with the associated respective fuel dispensing assembly, wherein the respective actuator assembly is operative in response to suitable control commands applied thereto to selectively cause the associated nozzle assembly to be placed into a selective one of mating fueling engagement with the fuel inlet of the associated vehicle and disengagement from the associated vehicle fuel inlet; and operating the respective actuator assembly in accordance with the associated control commands generated by the remote operations facility.

Each respective information transmission step of each respective operative performance step associated with each respective one of the plurality of refueling transaction requests further comprises the steps of: providing a respective dedicated controller operatively connected to the associated fuel dispensing assembly, the associated actuator assembly, and the associated second wireless communications device. The respective dedicated controller is operative to control the dispensing of fuel by the associated fuel dispensing assembly, control the operation of the associated actuator assembly, and transmit to the remote operations facility information relating to the respective one refueling transaction request provided by the associated first wireless communications device to the associated second wireless communications device.

The remote operations facility further performs, in respect of each respective one of the plurality of refueling transaction requests, the step of issuing the associated control commands generated by the remote operations facility to the associated dedicated controller for conducting operative control of the associated fuel dispensing assembly by the associated dedicated controller and operative control of the associated actuator assembly by the associated dedicated controller in accordance with the issued associated control commands.

Each respective operative performance step associated with each respective one of the plurality of refueling transaction requests further comprises the steps of: generating respective position signals representative of the position of the associated actuator assembly relative to the associated vehicle and relative to the associated nozzle assembly; providing the respective generated position signals to the associated dedicated controller; and transmitting the respective generated position signals from the associated dedicated controller to the remote operations facility.

The remote operations facility further performs, in respect of each respective one of the plurality of refueling transaction requests, the steps of: (a) evaluating the associated information received from the associated dedicated controller to make a respective decision regarding a selective one of approval and denial of the respective one refueling transaction request, generating respective dispenser control signals based on the evaluation of the associated information and developed in accordance with the respective refueling decision, wherein the respective generated dispenser control signals are representative of a respective selectable refueling activity for the associated fuel dispensing assembly, and transmitting the respective generated dispenser control signals to the associated dedicated controller for operative control action in accordance therewith; (b) evaluating the associated position signals received from the associated dedicated controller, generating respective actuator assembly control signals based on the position signals evaluation, wherein the respective generated actuator assembly control signals are representative of an operational repositioning activity for the associated actuator assembly relative to maneuvering the associated nozzle assembly into a selective one of engagement and disengagement relative to the fuel inlet of the associated vehicle, and transmitting the respective generated actuator assembly control signals to the associated dedicated controller for operative control action in accordance therewith; and (c) evaluating data signals received from the associated dedicated controller that are representative of an operational state of the associated fuel dispensing assembly to determine if the selected respective refueling activity has been completed, and, upon an affirmative determination of the completion of refueling activity, transmitting to the associated dedicated controller respective control signals sufficient to operate the associated actuator assembly to cause the disengagement of the associated nozzle assembly from the fuel inlet of the associated vehicle.

The method, in one form thereof, further comprises the steps of: providing a communications network operatively connected to the remote operations facility, wherein the communications network is arranged to provide communications access to at least one merchant to enable the execution of a transaction therewith by the remote operations facility in accordance with an associated transaction request operatively received from a corresponding respective one of the plurality of service station sites in association with a corresponding respective one of the plurality of vehicles. The method further comprises the steps of: generating at the corresponding respective one service station site a commercial transaction request relating to commercial activity involving a selective one of the at least one merchant; transmitting the generated commercial transaction request to the remote operations facility; wherein the remote operations facility performs the steps of processing the commercial transaction request transmitted thereto and conducting a transaction with the corresponding one of the at least one merchant associated with the commercial transaction request in accordance with the processing activity for the commercial transaction request.

The step of providing a communications network further includes the step of providing an internet facility including a respective electronic commerce site for each one of the at least one merchant that enables the operative processing of transaction requests characterized by electronic commerce activity.

The invention, in another form thereof, comprises a method of handling a plurality of refueling requests each associated with a respective one of a plurality of vehicles each positioned for refueling at an associated one of a plurality of service station sites, wherein each one of the plurality of vehicles is operatively associated with a respective fuel dispensing assembly having a respective nozzle assembly and which is arranged to operatively provide fuel to the vehicle associated therewith. The method comprises, in combination, the steps of: providing a remote operations facility disposed remote from at least one of the plurality of service station sites; and operatively performing the following steps in relation to each respective one of the plurality of refueling transaction requests: providing a respective actuator assembly operatively associated with the associated fuel dispensing assembly, wherein the respective actuator assembly is operative in response to suitable control commands applied thereto to controllably cause the associated respective nozzle assembly to be placed into a selective one of mating fueling engagement with the fuel inlet of the associated vehicle and disengagement from the associated vehicle fuel inlet; providing a respective control assembly operatively connected to the associated fuel dispensing assembly and operatively connected to the respective actuator assembly; wirelessly transmitting from the associated vehicle to the respective control assembly respective information relating to the respective one refueling transaction request; transmitting from the respective control assembly to the remote operations facility the respective information wirelessly transmitted to the respective control assembly; wherein the remote operations facility performs the steps of processing the respective information received from the respective control assembly to make a refueling decision regarding a selective one of approval and denial of the respective one refueling transaction request, generating respective control commands based on the respective information processing activity, and transmitting the respective generated control commands to the respective control assembly, wherein the respective generated control commands are representative of a respective selectable refueling operation for the associated vehicle; wherein the respective control assembly operatively controls the operation of the respective actuator assembly and the operation of the associated respective fuel dispensing assembly in accordance with the respective control commands received from the remote operations facility.

Each respective wireless information transmission step of each respective operative performance step associated with each respective one of the plurality of refueling transaction requests further comprises the steps of: providing a respective first wireless communications device integral with the associated vehicle and having at least one of a transmit capability and a receive capability; and operatively activating the respective first wireless communications device to establish operative communications with the associated control assembly. The operative communications between the respective first wireless communications device and the associated control assembly includes respective information relating to the respective one refueling transaction request. Each respective operative activation of the associated first wireless communications device associated with each respective one of the plurality of refueling transaction requests occurs through selective engagement thereof by a respective customer associated with the associated vehicle.

Each respective control assembly providing step of each respective operative performance step associated with each respective one of the plurality of refueling transaction requests further comprises the steps of: providing a respective second wireless communications device that is disposed at the associated service station site in a manner sufficient to enable operative communications with the associated first wireless communications device while the associated vehicle is positioned for refueling relative to the associated respective fuel dispensing assembly.

Each respective operative performance step associated with each respective one of the plurality of refueling transaction requests further comprises the steps of: providing to the associated control assembly respective position signals that are representative of the position of the associated actuator assembly relative to the associated vehicle and relative to the associated nozzle assembly; and transmitting from the associated control assembly to the remote operations facility the respective provided position signals.

The remote operations facility further performs, in respect of each respective one of the plurality of refueling transaction requests, the steps of: (a) evaluating the associated information received from the associated control assembly to make a respective decision regarding a selective one of approval and denial of the respective one refueling transaction request, generating respective dispenser control signals based on the evaluation of the associated information and developed in accordance with the respective refueling decision, wherein the respective generated dispenser control signals are representative of a respective selectable refueling activity for the associated fuel dispensing assembly, and transmitting the respective generated dispenser control signals to the associated control assembly for operative control action in accordance therewith; (b) evaluating the associated position signals received from the associated control assembly, generating respective actuator assembly control signals based on the position signals evaluation, wherein the respective generated actuator assembly control signals are representative of an operational repositioning activity for the associated actuator assembly relative to maneuvering the associated nozzle assembly into a selective one of engagement and disengagement relative to the fuel inlet of the associated vehicle, and transmitting the respective generated actuator assembly control signals to the associated control assembly for operative control action in accordance therewith; and (c) evaluating respective data received from the associated control assembly that is representative of an operational state of the associated fuel dispensing assembly to determine if the respective selected refueling activity has been completed, and, upon an affirmative determination of the completion of refueling activity, transmitting to the associated control assembly respective control signals sufficient to operate the associated actuator assembly to cause the disengagement of the associated nozzle assembly from the fuel inlet of the associated vehicle.

The method, in another form thereof, further comprises the steps of: providing a communications network operatively connected to the remote operations facility, wherein the communications network is arranged to provide communications access to at least one merchant to enable the execution of a transaction therewith by the remote operations facility in accordance with an associated transaction request operatively received from a corresponding respective control assembly associated with a corresponding respective one of the plurality of vehicles. The method further comprises the steps of: transmitting from the respective first wireless communications device associated with the respective one control assembly to the second wireless communications device associated with the respective one control assembly a commercial transaction request relating to commercial activity involving a selective one of the at least one merchant; transmitting the commercial transaction request received by the associated second wireless communications device to the remote operations facility; wherein the remote operations facility performs the steps of processing the commercial transaction request transmitted thereto and conducting a transaction with the corresponding one of the at least one merchant associated with the commercial transaction request in accordance with the processing activity for the commercial transaction request.

The step of providing a communications network further includes the step of providing an internet facility including a respective electronic commerce site for each one of the at least one merchant that enables the operative processing of transaction requests characterized by electronic commerce activity.

One advantage of the present invention is that the fuel delivery system can be fully automated by employing a wireless communications arrangement to facilitate communications between the vehicle and dispenser system and by utilizing a hydraulic robotic arm to facilitate controllable movement of the nozzle assembly into fueling engagement with the vehicle, thereby allowing the customer to remain in the vehicle during the entire refueling operation.

Another advantage of the present invention is that the central system controller located at the remote service facility can perform the full range of processing operations needed to process all of the refueling transaction requests generated by the various service station sites.

Another advantage of the invention is that the off-site centralized processing of the refueling requests (i.e., at the remote service facility) eliminates the need found with conventional systems to install dedicated processing equipment into each fuel dispensing apparatus configured at each one of the service station sites.

Another advantage of the present invention is that the centralized transaction processing afforded by the remote central system controller permits an implementation for the dedicated on-site controllers located at the service station sites that is relatively simple, namely one that essentially provides a transmit/receive capability and a control function that can be found in an Internet-type appliance.

A further advantage of the invention is that the centralized system controller provides the customer with the opportunity to request additional commercial transactions unrelated to the current refueling activity by establishing a communications capability between the remote service facility and other commercial retailers, for example by connecting the remote service facility to a communications network such as the Internet or Worldwide Web that provides access to various online merchants where electronic commerce activity can be conducted by the central system controller at the request of the customer, thereby providing the customer with a one-stop purchasing opportunity at the service station site.

A further advantage of the invention is that the automated fuel delivery system employs high-speed, high-bandwidth communication links to connect the remote service facility with each one of the multiple service station sites, thereby optimizing communications with the remote service facility.

A further advantage of the invention is that the customer can communicate with the remote service facility in an automated fashion from within the vehicle by employing an RF transceiver installed in the vehicle which communicates with a corresponding RF transceiver integrated within the fuel dispensing assembly.

A further advantage of the invention is that the physical task of refueling the vehicle can be performed automatically without any assistance from the customer by utilizing a robotics type actuator assembly that is controllably activated by the centralized system controller to cause the nozzle assembly to be placed into a selective one of engagement and disengagement with the vehicle fuel inlet.

A yet further advantage of the invention is that the remote service facility can be operated in a fully automated fashion or staffed with various levels of on-hand operator assistance to create the most favorable customer service relationship.

A yet further advantage of the invention is that the automated fuel delivery system supports a wide-bandwidth information exchange between the customer and remote service facility that involves various types of signals, e.g., data, voice, video, and control.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
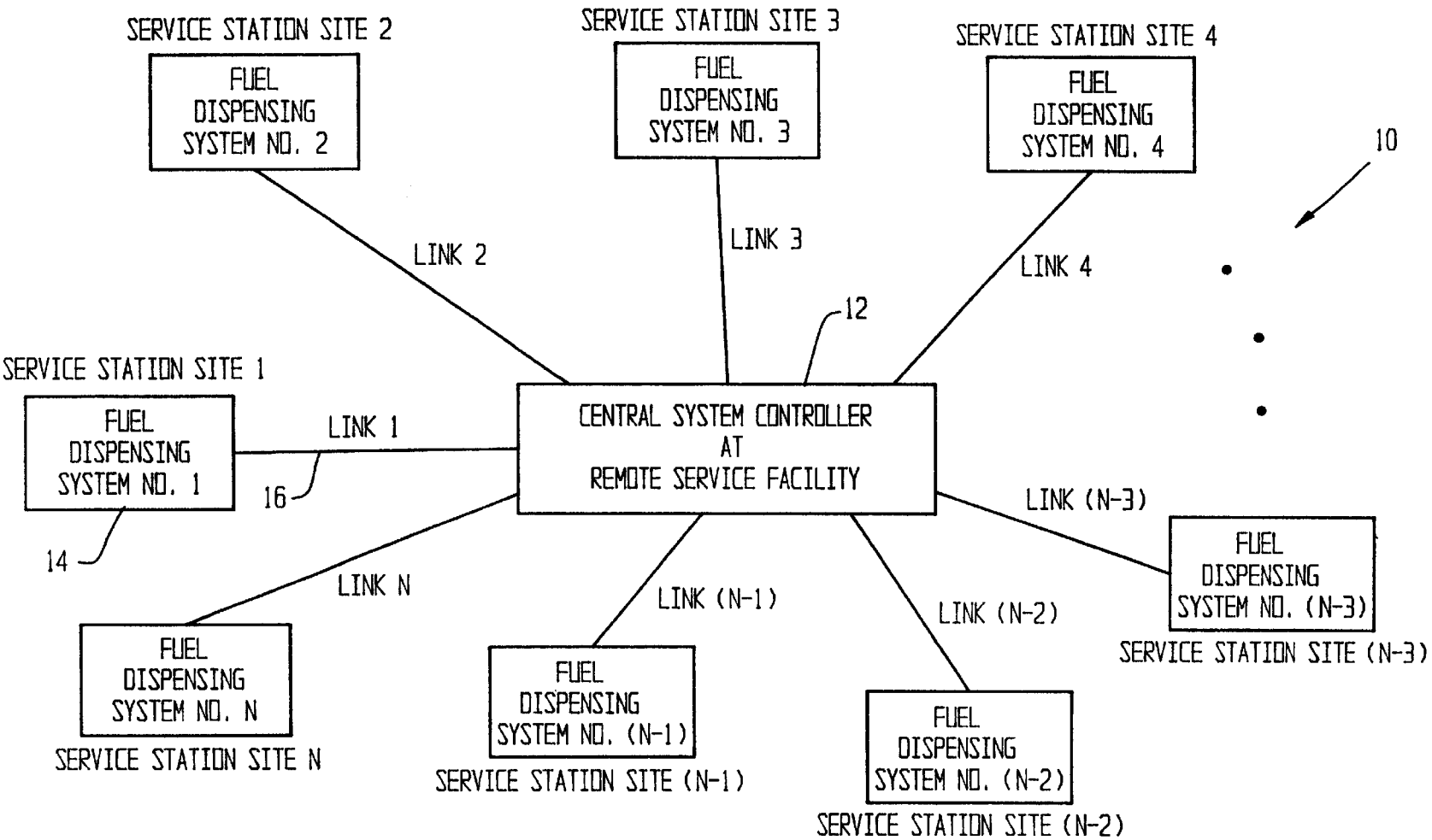
FIG. 1 is a diagrammatic illustration depicting the manner in which the automated fuel delivery system according to the present invention can provide a remotely-located centralized system controller that supervises, manages, and directs the refueling operations of a network of fuel dispensing systems distributed throughout various service station sites.

Referring now to the drawings and particularly to FIG. 1, there is shown in illustrative diagrammatic view an automated fuel delivery system 10 according to the present invention that provides a central system controller 12 configured at a remote service facility for processing and managing a plurality of customer refueling transaction requests originating from a plurality of refueling service station sites. In particular, central system controller 12 performs in a centralized manner the processing and control management tasks associated with the refueling transaction requests generated by a plurality N of fuel dispensing systems (individually represented at 14) networked to central system controller 12 via an associated plurality N of communication links (individually represented at 16). The fuel dispensing systems 14 are disposed at a corresponding plurality N of service station sites (e.g., service station site No. 1). Each one of the fuel dispensing systems 14 includes a respective plurality of conventional fuel dispensing assemblies each capable of delivering fuel to a respective vehicle that is stationed proximately therewith. In accordance with the present invention, each one of these plural fuel dispensing assemblies is operatively associated with a respective dedicated on-site control system that operates in conjunction with remote central system controller 12 to deliver fuel to the associated vehicle in accordance with the processed refueling transaction request.

As will be discussed further, the automated fuel delivery system 10 of the present invention provides various advantageous features. For instance, the centralized processing of the refueling transaction requests performed by remote central system controller 12 is carried out in a multi-tasking manner that permits parallel processing of the plural refueling requests transmitted to it from the various service station sites. Additionally, the delivery of fuel to each vehicle involved in a refueling transaction is preferably accomplished in a fully automated fashion, allowing the customer to remain in the vehicle during the entire refueling operation and thereby avoiding the need to render any assistance in connection with handling the nozzle assembly or activating the fuel dispensing equipment. Moreover, the central system controller 12 is preferably arranged for communication with other commercial retailers and merchants to permit the refueling customer to request additional transactions unrelated to the original refueling operation. This communications arrangement may take the form of establishing a connection with the Internet or Worldwide Web to provide access to online merchants for conducting electronic commerce activity. Furthermore, the utilization of central system controller 12 to perform all of the transaction processing functions permits a simple implementation for the dedicated on-site controller. In particular, this dedicated on-site controller, which is operative to implement the control commands provided by remote central system controller 12, may take the form of a low-end Internet appliance that features a transmit-receive capability and a simple control functionality with respect to any connected equipment (e.g., the fuel dispensing equipment and robotic arm actuator assembly).

Although in FIG. 1 the illustrated automated fuel delivery system 10 includes a dedicated central system controller 12 networked to a respective plurality of fuel dispensing systems 14, this arrangement should not be considered in limitation of the present invention as it should be apparent that automated fuel delivery system 10 may be extended within the scope of the present invention to comprise a plurality of such central system controllers 12 each located at a respective remote service facility and each networked to a respective plurality of fuel dispensing systems 14.

Figure 2:
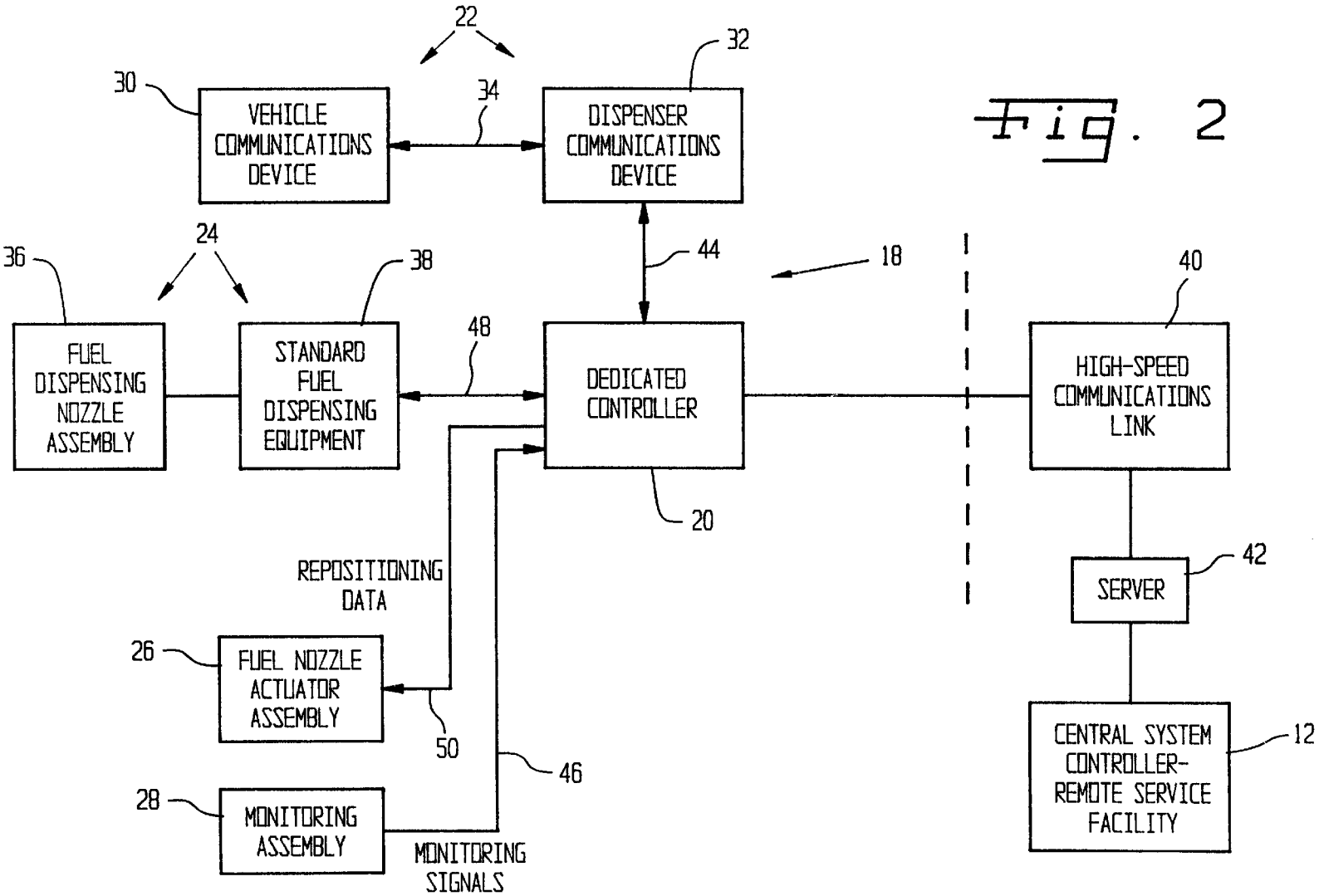
FIG. 2 is a block diagram illustration of a representative fuel delivery arrangement configured at a service station site to dispense fuel to an associated vehicle, in accordance with one embodiment of the present invention.

Referring now to FIG. 2, there is shown in block diagram format a representative fuel delivery arrangement 18 comprising a respective control system associated with a respective fuel dispensing assembly according to one embodiment of the present invention. This on-site fuel delivery arrangement 18 represents a dedicated configuration of components and subsystems disposed at a respective service station site that assists in the dispensing of fuel to a particular respective vehicle under the management and direction of central system controller 12. Accordingly, although FIG. 2 depicts a single dedicated fuel delivery arrangement 18, it should be understood that a plurality of such fuel delivery arrangements 18 collectively form, at least in part, each respective one of the plural fuel dispensing systems 14 associated with each respective one of the plural service station sites. In this manner, for each particular service station site, a plurality of vehicles may be refueled by a corresponding plurality of dedicated fuel delivery arrangements 18.

Referring again to FIG. 2, the illustrated fuel delivery arrangement 18 includes, in combination, a dedicated controller 20; a wireless communications arrangement indicated at 22 (which includes the illustrated communications device 30 associated with the vehicle and communications device 32 associated with the dispenser area); a conventional fuel dispensing assembly indicated at 24 (which includes the illustrated nozzle assembly 36 and fuel dispensing equipment 38); an actuator assembly 26; and a monitoring assembly 28. As shown, the illustrated fuel delivery arrangement 18 is configured for connection to central system controller 12 associated with the remote service facility. In particular, dedicated controller 20 is operatively connected to central system controller 12 via communications link 40 and server 42. Communications link 40 is preferably arranged as a high-speed, high-bandwidth communications line, while server 42 conventionally provides a routing and interface function to connect communications link 40 to central system controller 12. As discussed below in further detail, central system controller 12 preferably includes an arrangement of operator terminals configured to receive, process, manage, and direct the refueling transactions requested by the vehicle customer and transmitted to the remote service facility via communications devices 30 and 32, dedicated controller 20, and communications link 40.

Briefly, in operation, a customer initiates the refueling transaction by transmitting information relating to a refueling request from vehicle communications device 30 to dispenser communications device 32. The refueling request information received by dispenser communications device 32 is then forwarded to dedicated controller 20. Dedicated controller 20 further collects information from fuel dispensing assembly 24 and monitoring assembly 28 relating respectively to the operational status of fuel dispensing equipment 38 and the position of actuator assembly 26 relative to nozzle assembly 36 and the associated vehicle. Dedicated controller 20 places this collected information into a form suitable for transmission, preferably as a composite signal, which is then transmitted in an upstream manner to central system controller 12 via communications link 40 and server 42. Central system controller 12 performs operating control functions including, but not limited to, the steps of processing the signals received from dedicated controller 12; generating corresponding control information according to the signal processing results that is representative of control action to be taken by fuel delivery arrangement 18 with respect to a refueling operation for the vehicle; and transmitting the generated control information to dedicated controller 20 in a downstream manner. The control information includes control signals to suitably operate actuator assembly 26 such that nozzle assembly 36 is placed into fueling engagement with the vehicle fuel inlet and further includes control signals to activate fuel dispensing equipment 38. A more detailed description of the operation of the automated fuel delivery system is provided below.

As used herein, the remote relationship between the remote service facility (associated with central system controller 12) and the service station sites should be understood as encompassing any arrangement wherein the central system controller is located off-site from the individual discrete service station sites. In various forms all falling within the scope of the present invention, this off-site arrangement should be understood as including a remote service facility that in one form may be located geographically proximate to one or many of the service station sites, such as within the same city or region. Alternatively, in accordance with one preferred aspect of the present invention, the remote service facility will be located at a more significant distance from the service station sites, such as across the country or in another nation, which requires a communications link 40 of the type that can rapidly facilitate such long-distance communications (e.g., satellite communications, fiber-optic line, or high-speed, video-phone compatible lines). These examples are merely illustrative of the remote feature for central system controller 12 and should not be considered in limitation of the present invention.

Referring now to the individual subsystems depicted in FIG. 2, the illustrated fuel dispensing assembly 24 conventionally includes a fuel dispensing nozzle assembly 36 arranged in a known manner with fuel dispensing equipment 38 of standard construction. A fuel supply (not shown) provides fuel to fuel dispensing equipment 38. The illustrated actuator assembly 26 functions to controllably move nozzle assembly 36 into a selective one of engagement and disengagement with respect to the vehicle fuel inlet. The engagement operation precedes the commencement of the refueling activity while the disengagement operation follows the completion of the refueling activity. The illustrated monitoring assembly 28 provides signals representative of the position of actuator assembly 26 relative to nozzle assembly 26 and relative to the associated vehicle, specifically the fuel inlet thereof.

The illustrated actuator assembly 26 is preferably provided in the form of a dedicated robotic assembly operatively connected to dedicated controller 20. The robotic assembly conventionally includes a movable arm member that is mounted to a body portion supported by a platform structure. The robotic assembly is preferably powered by hydraulic activation, although other suitable driving mechanisms such as an electric motor may be used. For this purpose, a fluid source of controllable hydraulic pressure is provided in operative association with the robotic assembly. The robotic assembly is placed in a well known manner proximate nozzle assembly 36 such that the range of motion available to the robotic assembly enables the hydraulic arm to be moved into suitable engagement with nozzle assembly 36 so that nozzle assembly 36 can then be guided into proper fueling engagement with the vehicle fuel inlet. This robotic implementation should not be considered in limitation of the present invention as it should be apparent that other forms and types of actuator assemblies can be used.

The illustrated monitoring assembly 28 is preferably provided in the form of a vision system operatively connected to dedicated controller 20 and arranged to provide monitoring signals (i.e., video signals) representative of the positional relationship of actuator assembly 26 relative to the vehicle and relative to nozzle assembly 36. This video system may take the form of a CCD (charge-coupled device) camera mounted to the hydraulic arm of the robotic assembly. A continuous real-time video signal is preferably transmitted from the vision system (i.e., camera) to central system controller 12 via dedicated controller 20. Monitoring assembly 28 may alternatively be provided in the form of a sensor arrangement associated with actuator assembly 26 and operative to provide a measure of the position of actuator assembly 26 (e.g., location and orientation) and to generate position signals representative thereof. These illustrative embodiments for monitoring assembly 28 should not be considered in limitation of the present invention as it should be apparent that other means may be provided to generate position signals pertaining to actuator assembly 26 that enable central system controller 12 to accurately determine the manner of operating actuator assembly 26 so as to properly engage nozzle assembly 36 and then guide the as-engaged nozzle assembly 36 into fueling relationship with the vehicle.

The cooperative arrangement of actuator assembly 26 and monitoring assembly 28 implements an automated operating feature in accordance with one aspect of the present invention. In particular, the full range of manual refueling tasks required of the customer in conventional fuel dispensing systems can now be accomplished by actuator assembly 26. Based upon a continuous evaluation of the monitoring signals provided by monitoring assembly 28, the robotic arm of actuator assembly 28 can be properly maneuvered so as to place nozzle assembly 36 into fueling engagement with the vehicle. This automation of the fuel dispensing function does not require any physical involvement of the customer, who can therefore remain in the vehicle.

The illustrated wireless communications arrangement 22 includes, in one form thereof, a first wireless communications device 30 integrated with a vehicle that is suitably stationed for refueling relative to fuel delivery arrangement 18. For example, the vehicle would be arranged proximate fuel dispensing assembly 24 in a well known manner to enable the associated nozzle assembly 36 to access the vehicle fuel inlet. Conventional techniques and methodologies are suitable for installing communications device 30 into the associated vehicle. Communications arrangement 22 further includes a second wireless communications device 32 integrally associated, in a preferred form thereof, with the housing structure containing fuel dispensing assembly 24. Dispenser communications device 32 is suitably disposed at the associated service station site (e.g., at the relevant fuel dispensing equipment 38 area) in a manner sufficient to enable operative communications with vehicle communications device 30 while the vehicle is disposed in refueling relationship relative to fuel dispensing assembly 24.

This wireless communications configuration realized by communications devices 30 and 32 implements an automated operating feature in accordance with another aspect of the present invention. In particular, unlike conventional systems where the customer is required to exit the vehicle to interact with an input module to initiate the refueling transaction request, the vehicle-equipped communications device 30 permits the customer to conduct all of the necessary transaction-related communications with central system controller 12 while remaining in the vehicle. These customer transmissions are automatically forwarded upstream via dispenser communications device 32 and dedicated controller 20 to central system controller 12 for processing action in accordance therewith. Likewise, return communications from central system controller 12 to the customer may be similarly developed in an automated fashion on the downstream link.

Each one of the illustrated wireless communications devices 30 and 32 preferably includes a respective transmit/receive capability allowing a bi-directional exchange of information over wireless pathway 34. For customer transmissions relating to a refueling activity, this information comprises a refueling request and preferably includes voice signals generated by the customer and data signals representative of transactional information associated with the refueling request, e.g., credit card information. For purposes of allowing the customer to generate personalized or customized information for subsequent transmission, communications device 30 preferably includes an interactive mechanism that allows the user to input various types of instructions, commands, and/or data signals. Alternatively, these commands and data sets may be preprogrammed into an associated memory and recalled with an access interface module (e.g., programming interface) activated by the customer. Vehicle communications device 30 may be further adapted to include suitable microphone, encoding and modulation equipment to allow the customer to transmit voice signals over wireless pathway 34. Likewise, dispenser communications device 32 will include the proper circuitry to decode and demodulate the transmitted voice signal. Alternatively, since the vehicle and fuel dispensing station are in relatively close proximate relationship to one another, the customer may optionally elect to speak directly into a microphone unit integrally connected with dispenser communications device 32. This microphone unit would, for example, perform all of the signal processing needed to retrieve the original baseband voice signal.

The illustrated dedicated controller 20 includes a communications functionality and a control functionality that act in cooperative association with central system controller 12 to implement the refueling command control decisions developed by central system controller 12 in accordance with the centralized processing operation involving the refueling transaction request. Dedicated controller 20, in one aspect thereof, serves to provide central system controller 12 with the transaction-related information generated by the customer and with the other information needed to develop the refueling control action response. In particular, dedicated controller 20 performs a variety of functions including but not limited to: receiving over line 44 the refueling transaction request information transmitted by vehicle communications device 30 to dispenser communications device 32; receiving over line 46 the monitoring signals generated by monitoring assembly 28 that are representative of the position of actuator assembly 26; and receiving over line 48 the operating status signals that are representative of the operational status of fuel dispensing equipment 38 (e.g., active/inactive and flow rate). Dedicated controller 20 places these signals into a format suitable for transmission and then transmits the formatted signals over communications link 40. For this purpose, dedicated controller 20 is equipped with suitable signal processing devices such as modulators/demodulators, encoders/decoders, interface modules, and other appropriate transmit/receive circuitry known to those skilled in the art to facilitate connection to and communication with communications link 40. As shown, dedicated controller 20 is arranged for operative connection with dispenser communications device 32, fuel dispensing equipment 38, actuator assembly 26, monitoring assembly 28, and communications link 40.

Dedicated controller 20, in another aspect thereof, includes a control functionality that serves to operate fuel dispensing assembly 24 and actuator assembly 26 in accordance with control command information received from central system controller 12 so as to implement a refueling activity involving the associated vehicle. The control command information received by dedicated controller 20 takes the form of fuel dispensing control signals delivered over line 48 to fuel dispensing equipment 38 and repositioning data delivered over line 50 to actuator assembly 26. The repositioning data will be effective in selectively maneuvering actuator assembly 26 so as to enable it to place nozzle assembly 36 into proper fueling engagement with the vehicle fuel inlet. The fuel dispensing control signals will be effective in selectively regulating the dispensing of fuel through nozzle assembly 36. The dispensing of fuel will of course be coordinated in the appropriate manner with the operation of actuator assembly 26, namely after dedicated controller 20 receives an indication to proceed with operative control of fuel dispensing equipment 38 following the completion of the repositioning of nozzle assembly 36 by actuator assembly 26.

Dedicated controller 20, in a preferred form thereof, may be implemented as an Internet appliance or device having a communications facility (i.e., transmit/receive capabilities) and a control facility capable of effecting operative control of any associated equipment, i.e., actuator assembly 26 and fuel dispensing equipment 38. This type of simple low-end implementation for dedicated controller 20 is made possible by the fact that the processing functions relating to the transaction request are carried out at the remote service facility by central system controller 12. By centralizing all of the processing operations in central system controller 12, dedicated controller 20 simply needs to be provided in a form sufficient to transfer the transaction-related information to the remote service facility and to carry out the refueling control activity that is formulated by central system controller 12 in response to the transaction request. Without limiting the present invention, it may be considered that there is in effect a master-slave relationship between central system controller 12 and dedicated controller 20. Similarly, it may be considered that the relationship between central system controller 12 and each one of the discrete dedicated controllers 20 arranged at the various service station sites may be characterized as defining a satellite configuration.

It is apparent from fuel delivery arrangement 18 that dedicated controller 20 may also be used to provide information to the customer by having such information transmitted from dispenser communications device 32 to vehicle communications device 30. This information would be generated by central system controller 12 at the remote service facility and conveyed to dedicated controller 20 over the associated communications link 40. This information could include a greeting to the customer, instructions to release the fuel inlet door to prepare for refueling, confirmation of the acceptance of the refueling request, and an invitation to execute other commercial transactions unaffiliated with the current refueling activity. These unrelated transactions would include, for example, the purchase of merchandise and other commodities from online merchants having "cyberspace" retail sites on an Internet-type communications network that is accessible by central system controller 12, which is suitably adapted to process, conduct, and otherwise perform online e-commerce (i.e., electronic commerce) transactions. This feature relating to the execution of additional commercial transactions is discussed further in greater detail.

Referring still to FIG. 2, the illustrated communications link 40 provides the operative connectivity between the remote service facility and the service station site associated with fuel delivery arrangement 18. In particular, communications link 40 provides a communications pathway between central system controller 12 at the remote service facility and the respective dedicated controller 20 at the service station site. Various implementations of communications link 40 may include a fiberoptic link, an RF communications link, a satellite link, and a long-haul communications link such as that being conventionally used by long-distance telephone carriers. Communications link 40 will preferably feature a high-speed and high-bandwidth capability. In a preferred form, each one of the dedicated controllers at a particular service station site are connected to a common communications link 40. The illustrated server 42 is arranged and operated in a conventional manner to facilitate interfacing and connection between communications link 40 and central system controller 12.

The illustrated central system controller 12 performs a variety of functions including, but not limited to, the processing, management and control command implementation of each one of the transmitted refueling transaction requests received at the remote service facility. As discussed previously, each one of the incoming refueling requests originates from a respective customer associated with a respective fuel delivery arrangement 18 at an associated one of the service station sites. For each one of the respective refueling request transmissions received at the remote service facility, central system controller 12 broadly operates to process the incoming refueling request information (which is transmitted by the respective dedicated controller 20) and to generate control information based upon the processing results. The generated control information is representative of control action to be taken by fuel delivery arrangement 18 under the direction of dedicated controller 20 to implement a refueling operation for the vehicle. In particular, this control activity that is formulated by central system controller 12 in response to the refueling transaction request is communicated to dedicated controller 20 in the form of corresponding control command information.

The functionality of central system controller 12 pertains specifically to the processing of various signals received from dedicated controller 20, namely the refueling request information transmitted by vehicle communications device 30 to dispenser communications device 32, the monitoring signals generated by monitoring assembly 28 (e.g., the video signals from a camera-based vision system), and the fuel dispensing status data provided by fuel dispensing equipment 38, which is representative of an operational state thereof. Central system controller 12, in one aspect thereof, performs an evaluation of the refueling request information to make a decision regarding a selective one of approval and denial of the refueling request. Control signals for suitably operating fuel dispensing equipment 38 are generated based upon the outcome of the evaluation and in conformity with the refueling decision. Accordingly, the generated dispenser control signals are specifically representative of a selectable refueling activity for the fuel dispensing system. The dispenser control signals are transmitted to dedicated controller 20 for operative action in accordance therewith.

Central system controller 12 further performs an evaluation of the monitoring video signals and generates actuator assembly control signals based upon the video signals evaluation. The generated actuator assembly control signals are representative of an operational repositioning activity for actuator assembly 26 with respect to maneuvering nozzle assembly 36 into a selective one of engagement and disengagement relative to the fuel inlet of the vehicle depending upon whether the refueling activity is being commenced or has been completed. These actuator assembly control signals are likewise transmitted to dedicated controller 20 for operative action in accordance therewith. Central system controller 12 further performs an evaluation of the fuel dispensing data to determine if the selected refueling activity has been completed. Upon an affirmative determination of such completion, central system controller 12 generates and transmits to dedicated controller 20 suitable control signals that are sufficient to operate actuator assembly 26 to cause the disengagement of nozzle assembly 36 from the fuel inlet of the vehicle.

The remote service facility associated with central system controller 12 is preferably assigned to a location that is remote from each one of the service station sites to which it is connected. The long-haul, high-speed and high-bandwidth characteristics of communications link 40 makes this remote feature feasible because it enables central system controller 12 to receive the transaction-related information, carry out its processing and control formulation tasks, and make the necessary transmissions to dedicated controller 20 within a short response interval following the original customer request.

Figure 3:
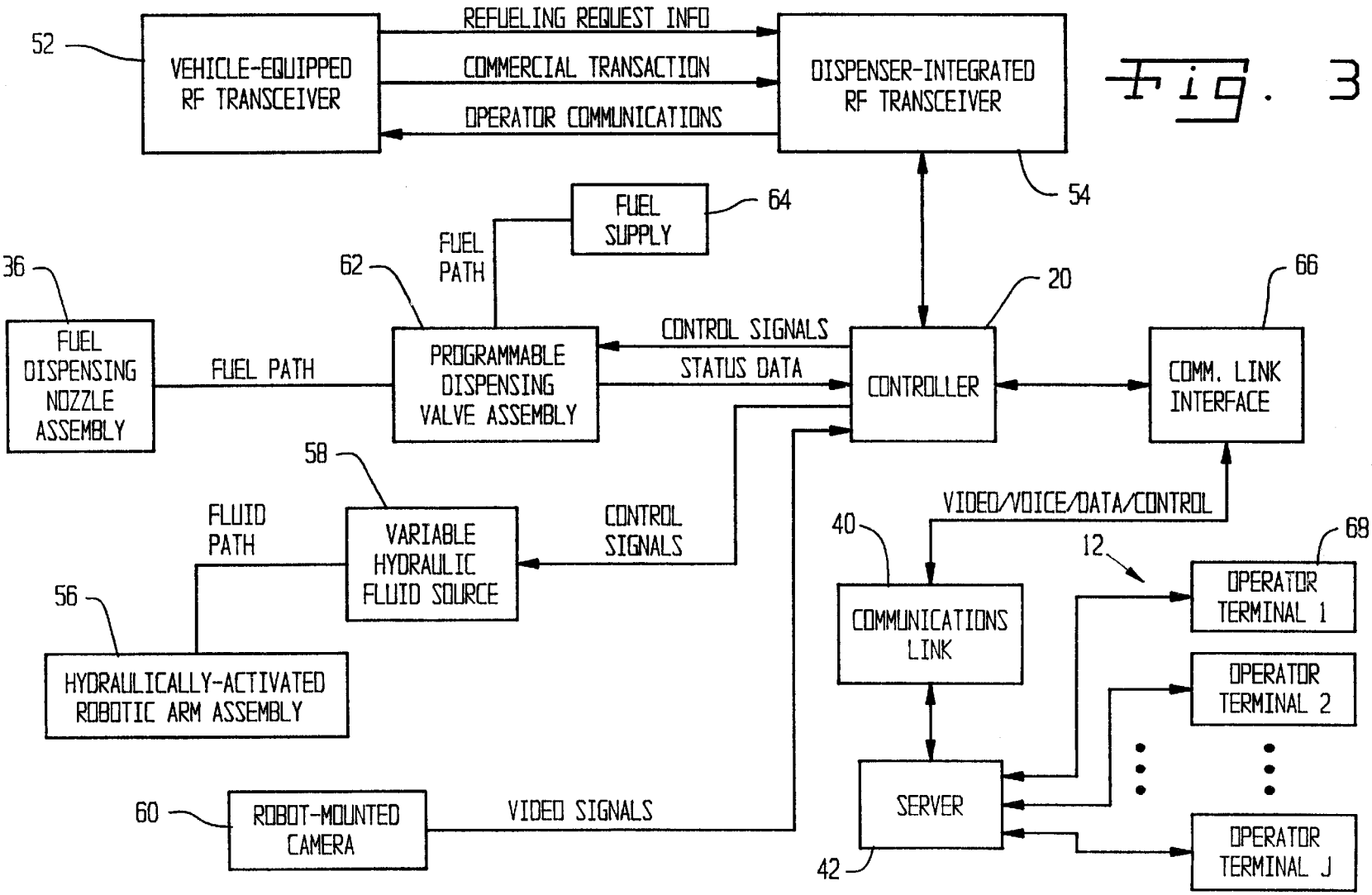
FIG. 3 is a detailed block diagram illustration of the fuel delivery arrangement shown in FIG. 2, in accordance with another embodiment of the present invention.

Referring now to FIG. 3, there is shown in block diagram format one illustrative implementation of the system shown in FIG. 2, in accordance with another embodiment of the present invention. As shown, vehicle communications device 30 of FIG. 2 is provided in the form of an RF transceiver 52 installed in the vehicle, while dispenser communications device 32 is provided in the form of an RF transceiver 54 preferably integrated with fuel dispensing equipment 38. Vehicle-equipped RF transceiver 52 may be provided as a currently available RFID device or preferably as a two-way (i.e., bi-directional) RF voice/data device, which is readily available and could be modified to include a set of status LEDs to be used for customer visual interface during the fueling process (e.g., flashing red to indicate fueling in progress). This vehicle RF device 52, for example, can be incorporated directly into new vehicles in a manner similar to the current factory installation of remote garage door openers. Additionally, the factory sound system could be adapted to incorporate the facilities needed to support the bi-directional voice communications.

Referring still to FIG. 3, actuator assembly 26 of FIG. 2 is preferably provided in the form of robotic arm assembly 56 activated using hydraulic pressurization supplied by a variable pressurized fluid source 58. Monitoring assembly 28 of FIG. 2 is preferably provided in the form of camera 60 suitably mounted to robotic arm assembly 56 to provide a view of robotic arm assembly 56 relative to nozzle assembly 36 and relative to the vehicle. This view provided by camera 60 would be sufficient to enable central system controller 12 to properly evaluate the video signals generated therefrom to determine the proper manner of guiding nozzle assembly 36 into fueling engagement with the vehicle fuel inlet. Fuel dispensing equipment 38 of FIG. 2 illustratively includes a conventional programmable dispensing valve assembly 62 that controllably regulates the dispensing of fuel supplied by fuel supply 64.

Dedicated controller 20 is preferably provided in a form that includes, at least in part, a video phone-type arrangement to suitably handle the voice/data signals transmitted by vehicle RF transceiver 52 and to properly transmit these signals over communications link 40, which is preferably a high-bandwidth telephone/Internet line. Dedicated controller 20 is preferably provided with the appropriate encoding facility to encode the voice signals and video signals (from camera 60) into a JPEG format. Additionally, dedicated controller 20 includes an encryption facility to protect certain customer-sensitive information such as a credit card account number and other billing or transaction-related data. Dedicated controller 20 also includes the appropriate transmit and receive facilities known to those skilled in the art for enabling communications with central system controller 12 over communications link 40. In another form, dedicated controller 20 may be further arranged as an Internet device or appliance as previously discussed. Dedicated controller 20 is preferably arranged for integration into fuel dispensing equipment 38 or at least within the housing area containing such equipment.

Dedicated controller 20 is preferably connected to a suitable communications link interface 66 to facilitate connection to communications link 40. Communications link 40 carries, among other signals, JPEG-encoded video and voice in a manner similar to a video-phone communications transfer. For this purpose, communications link 40 may be implemented as economical high-bandwidth lines that are currently being installed throughout the country by GTE of Stamford, Conn. and other long-distance carriers. Communications link 40 uses the appropriate protocol to support the transfer of the JPEG-encoded video and voice. Server 42 may be provided in any of various conventional forms suitable for accommodating the connectivity of dedicated controller 20 via communications link 40 to central system controller 12. Server 42, for example, may be implemented with suitable product offerings commercially available from Cisco Systems of San Jose, Calif. and Lucent Technologies of Murray Hill, N.J.

Central system controller 12 is shown illustratively as an arrangement of individual operator terminals 68 preferably staffed and operated by personnel to provide an element of human interaction with the customer during the refueling transaction. Each operator terminal 68 receives refueling transaction requests from a plurality of dedicated controllers 20 associated, for example, with a plurality of service station sites. Among other functional capabilities, operator terminal 68 is able to establish voice communications with the customer via the wireless communications arrangement 22 (i.e., RF transceivers 52 and 54) and establish image-based monitoring of the refueling site (i.e., robotic arm assembly 56, nozzle assembly 36, and the vehicle) via camera 60. Operator terminal 68 is preferably provided with a joystick-type apparatus (not shown) as one illustrative means for generating repositioning data to properly maneuver robotic arm assembly 56. Data produced by this maneuvering mechanism will be provided in the form of x-y-z coordinates that are sufficient to control the movement of robotic arm assembly 56 in the desired manner. For this purpose, it is clear that the video signals generated by camera 60 should be continuously provided on the uplink path to operator terminal 68, while the x-y-x repositioning coordinates generated by the joystick-type apparatus should be continuously provided on the downlink path to provide a virtually real-time control of robotic arm assembly 56. The operator terminal 68 preferably includes a corresponding decryption facility sufficient to process any encrypted signals sent from dedicated controller 20.

Operator terminal 68 is preferably provided in the form of a personal computer, desk-top workstation or other suitable computing or analysis facility, such as the computer assemblies available from Dell Computer of Round Rock, Tex. and Sun Microsystems of Mountain View, Calif. In a conventional manner known to those skilled in the art, the remote service facility is provided with the appropriate transmission and reception facilities (not shown) such as modulators/demodulators and encoders/decoders to facilitate proper communications with communications link 40 and to properly condition and process the received signals and the signals intended for transmission. Although the refueling transaction is preferably managed by central system controller 12 with the assistance of staff personnel, a further enhancement within the scope of the present invention would involve fully automating the operation of central system controller 12 utilizing the appropriate computing facilities so as to make operator assistance unnecessary. For example, the processing equipment at operator terminal 68 (e.g., personal computers) would be provided with the proper software and programming modules in a manner known to those skilled in the art to fully automate the transaction processing and the control activity, e.g., automated maneuvering of the robotic arm.

Figure 4:
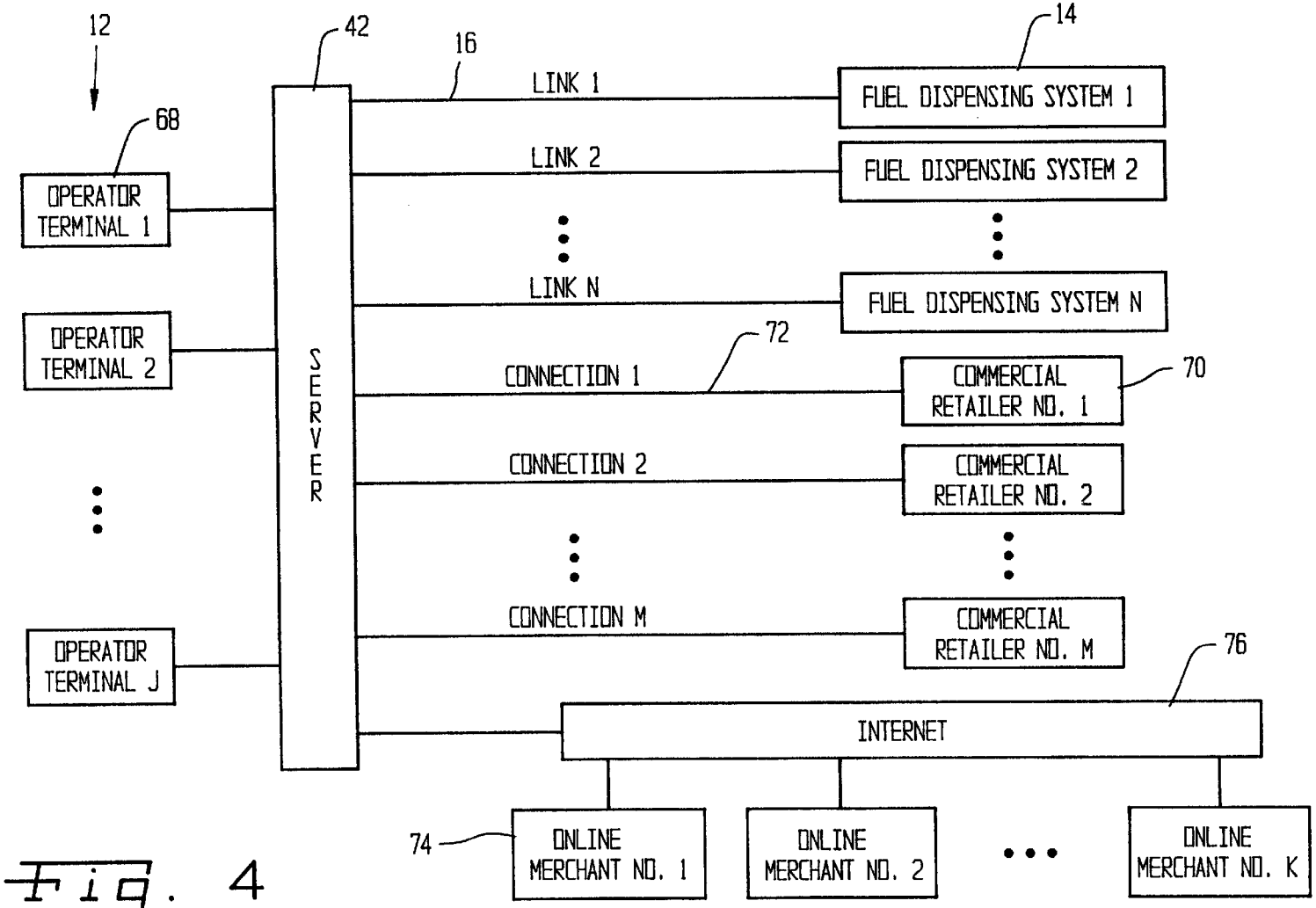
FIG. 4 is a detailed block diagram illustration of the remote service facility according to another embodiment of the present invention, depicting the networked connection of the central system controller to the refueling service station sites and to non-affiliated commercial institutions and online retail merchants.

Referring now to FIG. 4, there is shown in block diagram format a preferred networking arrangement for central system controller 12 that illustrates in particular the manner of enabling the operator terminals 68 at the remote service facility to access various commercial retailers and online merchants having electronically-developed sites on a distributed large-scale communications network (e.g., Internet or Worldwide Web). In particular, central system controller 12 is arranged for connection to a plurality M of commercial retailers 70 via respective connection paths 72 and further arranged for connection to a plurality K of online merchants 74 that are electronically accessible via Internet facility 76. As shown, the same server 42 can be used to facilitate these additional access connections or another dedicated server may be provided for this purpose. In the manner described previously, the operator terminals 68 are connected as shown to the plurality of fuel dispensing systems 14 for the purpose of receiving, processing and executing the refueling transaction requests made by the customer. The illustrated connectivity between the remote service facility and online merchants 74 is particularly noteworthy because it enables the customer to request additional transactions that can be executed by central system controller 12 pursuant to the proper electronic commerce activity.

The illustrated commercial retailers 70 may be contacted, for example, by utilizing a simple dial-up information exchange carried out over a conventional telephone line corresponding to connection 72. The contacted commercial retail sites would then correspond to the actual place of business where the purchased commodity or retail item could be retrieved by the customer after leaving the service station site. For instance, operator terminal 68 could respond to a request by the customer to order a take-out lunch from a local restaurant by calling the restaurant and placing the order in the customer's name. Payment for these supplemental transactions would use the same form of billing (e.g., credit or debit card) as for the refueling operation. In one alternative form, the networking arrangement involving commercial retailers 70 can be eliminated by instituting a licensing agreement between the service station company and the commercial retailers 70 that grants operator terminal 68 the authority to approve or deny transactions with respect to the retailer merchandise without requiring operator terminal 68 to contact retailer 70 each time a transaction arises. This business arrangement keeps intact the same transactional opportunities as present with the FIG. 4 networking configuration.

Referring now to the online electronic commerce activity featured in connection with online merchants 74, the emergence of large-scale communications networks such as the Internet and the Worldwide Web presents virtually unlimited opportunities for the automated fuel delivery system of the present invention to make available to the refueling customer a vast and diverse array of opportunities to make purchasing decisions extending well beyond the current refueling transaction. The customer can request various electronic commerce transactions via the online connection of central system controller 12 to the web sites of various retailers and merchants, which may be grouped into online virtual shopping malls and retail outlet networks pursuant to the commercially available Internet service offerings of Internet Service Providers (ISPs) such as America Online of Dulles, Va. and Yahoo! Inc. of Santa Clara, Calif. The illustrated Internet 76 is therefore representative of such communications networks and preferably corresponds to the Worldwide Web in which the merchant addresses are illustratively formatted as www.<businessidentifier>.com. Operator terminal 68 is therefore preferably equipped with the proper interfacing devices to connect to Internet 76 and is loaded with the proper software tools to search and move about Internet 76 and execute the requested commercial transactions. Examples of such software tools include the navigational and browser software packages available from Microsoft of Redmond, Wash. and Netscape Communications of Mountain View, Calif. and other commercially available e-commerce programming modules.

As previously described, the networked arrangement of commercial retailers 70 and online merchants 74 presents the refueling customer with the option of executing additional commercial transactions unrelated to the refueling activity at hand. Operator terminal 68 makes such an inquiry of the customer using the same communications pathway as employed for handling the refueling transaction request, namely RF transceivers 52 and 54 and dedicated controller 20. The transaction options, in various alternative forms, may be presented to the customer in visual form on a display monitor integrated with the fuel dispensing equipment, by voice communications originating from the operator, or as a data list submitted to the customer for review while remaining in the vehicle, i.e., transmitted to the vehicle over the RF transceiver pair. The customer may make a selection via voice response or by inputting the appropriate response data into RF transceiver 52 for upstream transfer to operator terminal 68 where the necessary steps are executed to complete the commercial transaction, namely by contacting the commercial retailers 70 and/or visiting the web-site or electronic address of the online merchants 74.

The operation of the automated fuel delivery system of the present invention will now be discussed in reference to FIGS. 3–5 as accompanied by the flowcharts shown in FIGS. 6 and 7, which respectively set forth in general representative form one illustrative sequence of operational steps carried out by the system to perform the refueling activity requested by the customer and to conduct other transactions proposed by the customer in relation to commercial activity that involves merchandise, commodities and other retail items that are unaffiliated with and do not represent an essential part of the current refueling activity, in accordance with a preferred aspect of the present invention.

Figure 5:
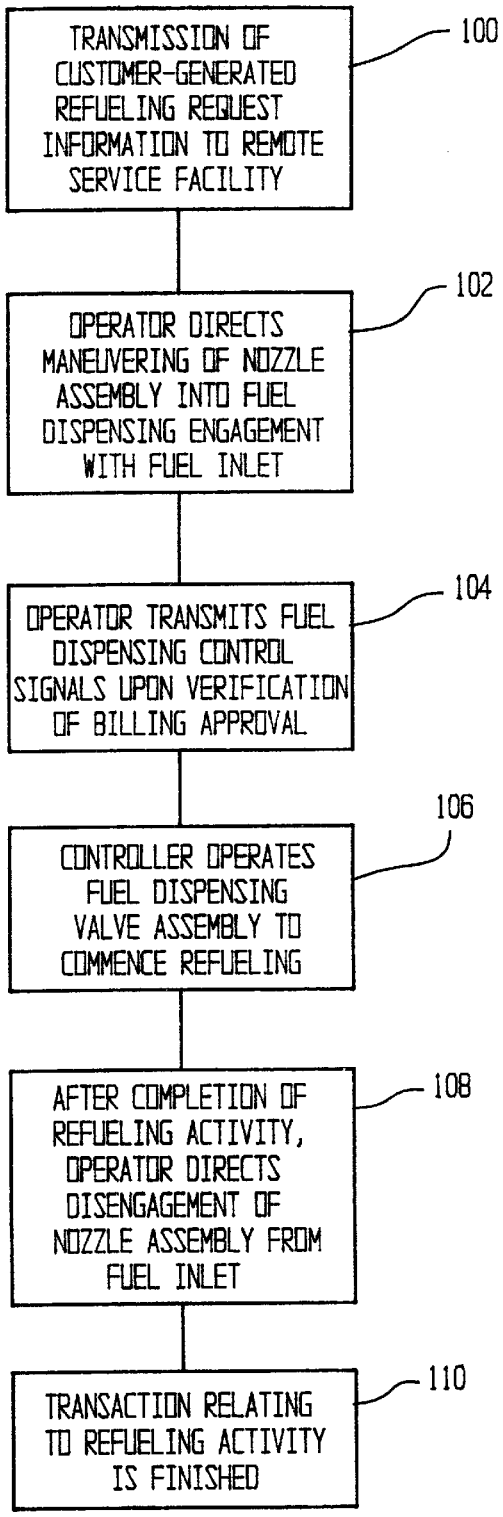
FIG. 5 is a flow diagram illustrating the sequence of operational steps involved in the refueling control operation performed by the automated fuel delivery system of the present invention.

Referring first to the flowchart of FIG. 5, a customer first drives into one of the service station sites and situates the vehicle in proximate refueling relationship relative to nozzle assembly 36. While remaining in the vehicle, the customer makes a request for a refueling transaction by transmitting such a request in the form of refueling request information from vehicle RF transceiver 52 to dispenser RF transceiver 54. Embedded in this transmitted information are various items including, but not limited to, credit card data, customer name, type and amount of fuel selected, and other relevant information. Dedicated controller 20 formulates a request signal, encrypts the credit card data, and transmits these signals via communications link 40 to an operator terminal 68 of central system controller 12 (step 100). Operator terminal 68 switches to the incoming packet containing the refueling request signals that are received at the remote service facility and establishes voice communications with the customer, extending a personalized greeting to the customer and requesting that the customer turn off the vehicle engine and release the fuel door for refueling.

The operator reviews the imaging information represented by the video signals produced by camera 60 to verify that the car is stationary and that the fuel door has been opened. Dedicated controller 20 preferably transmits the video signals to operator terminal 68 on a continuous basis to facilitate the proper maneuvering of robotic arm assembly 56. Based on this video information, the operator positions the dispenser nozzle assembly 36 into the vehicle fuel inlet by appropriately operating robotic arm assembly 56 utilizing the joystick-type apparatus (not shown) that is integrally associated with operator terminal 68 (step 102). Control commands representative of the joystick-directed repositioning sequence are applied by dedicated controller 20 to actuator assembly 26. The operator previously verifies that the transaction was approved by the credit card issuer and then sends a control signal to dedicated controller 20 directing it to effect suitable operative control of the fuel dispensing activity (step 104). In response, dedicated controller 20 generates the appropriate control signals to operate the programmable valve assembly 62 (step 106). At this point, the operator may switch to another refueling request while the immediately prior processed request proceeds through its approved refueling activity. In this manner it can be seen that central system controller 12 can function in a multi-tasking environment in which it is capable of handling in parallel a multiplicity of refueling requests. One alternative feature of this multi-processing capability may involve the use of a prioritized transaction processing scheme in which the incoming requests are handled in accordance with a prioritization strategy, such as setting priorities based upon the time of day and service station location. For example, a higher priority would be set for those requests originating from a high-density service area such as an urban location and occurring during a peak time period, i.e., rush hour.

When the fuel dispensing equipment 38 detects the completion of the refueling operation either by way of a full tank or when the requested amount has been fully dispensed, the dispensing equipment 38 generates status data representative of this completed condition and forwards this data to dedicated controller 20 for subsequent transmission to operator terminal 68. In response, operator terminal 68 disengages nozzle assembly 36 from the vehicle by issuing the proper control commands to dedicated controller 20 which in turn operatively controls robotic arm assembly 56 in the indicated manner. The operator then notifies the customer that the refueling operation is finished (steps 108 and 110).

Figure 6:
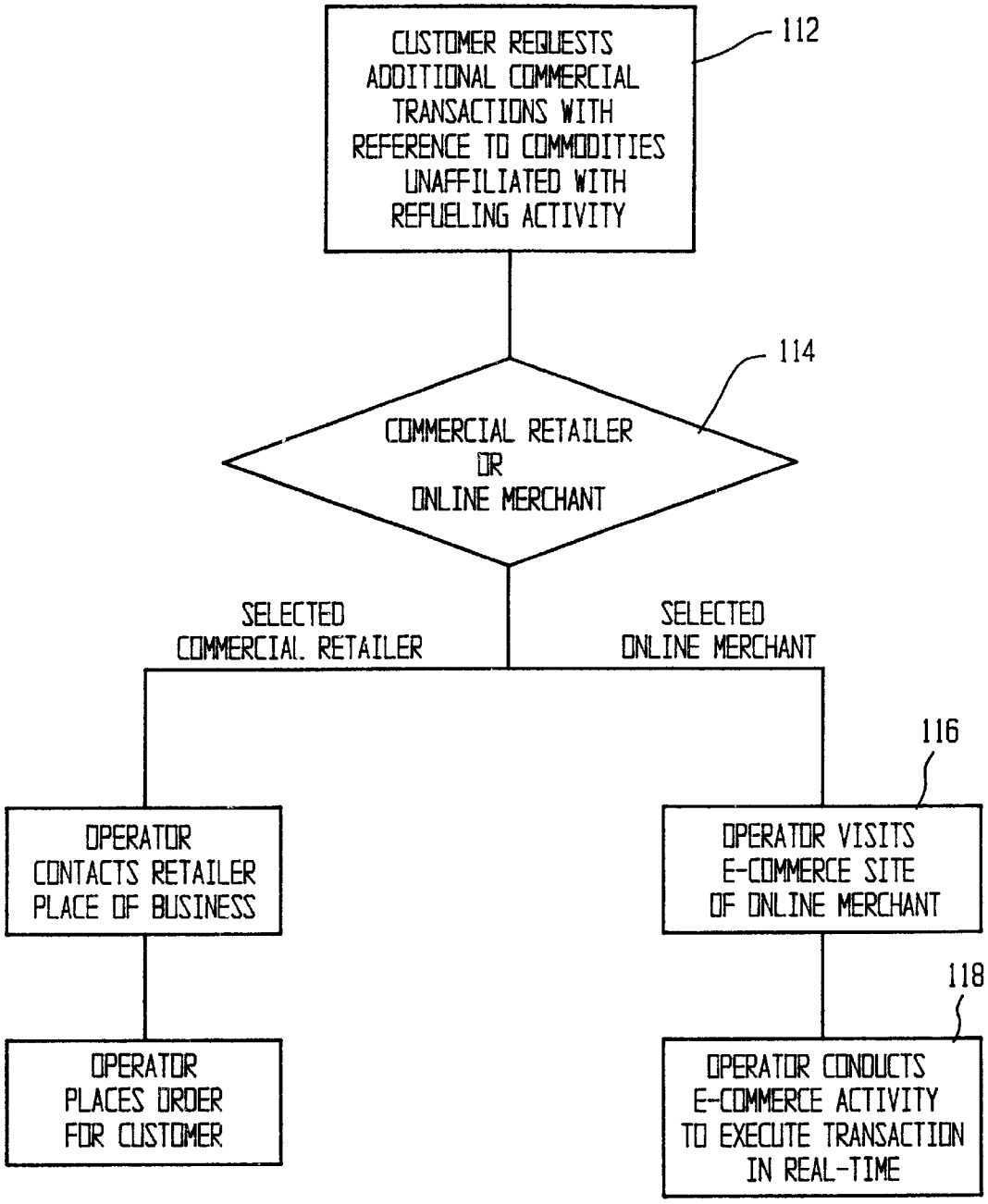
FIG. 6 is a flow diagram illustrating the sequence of operational steps involved in accommodating a request by the customer to conduct additional commercial transactions other than the refueling activity, in accordance with another embodiment of the present invention.

Referring now to the flowchart of FIG. 6, the customer may request that operator terminal 68 conduct additional commercial transactions involving entities such as commercial retailers 70 and online merchants 74 of FIG. 4 (step 112). This request may, in alternative forms, be embedded in the original refueling request, arise out of a separate and independent exchange between the customer and remote service facility during the refueling activity, or follow completion of the requested fuel dispensing operation. It should be apparent that these noted times of occurrence for the additional transaction requests are not exclusive of other transaction periods but merely illustrative thereof. Additionally, the transaction requests may be made in real-time at the invitation of operator terminal 68 or formulated by the customer in an unsolicited manner based upon a known or posted online merchant list.

After receiving the additional transaction request, operator terminal 68 illustratively executes the transaction by visiting the Web site of the indicated online merchant 74 and conducting the transaction in accordance with electronic commerce processing operations conventionally known in the industry (steps 116 and 118). The interconnectivity that is developed between the remote service facility and the virtually unlimited number of online merchants 74 having a presence on Internet 76 accrues significant benefits for vehicle refueling customers in terms of expanding and enhancing their transactional options. In many respects, a refueling service station site can effectively become a type of one-stop shopping facility. This Internet application allows a significant number of transactions to be rapidly and easily processed due to the fully electronic processing activity that underlies execution of the transaction. In a similar manner, operator 68 may present the customer with the option of purchasing items from the drive-through facility located at the service station site (not shown).

In accordance with the present invention, the automated fuel delivery system is distinguished by various beneficial features such as the delivery of fuel in a fully automated fashion and the centralized processing of refueling transaction requests originating from a plurality of customers distributed throughout a network of service station sites. This centralized processing is performed by a central system controller located at a selected remote service facility. The central system controller is preferably arranged for communication with a network of commercial retailers such as online merchants on the Worldwide Web in order to provide the customer with the opportunity to request additional transactions unrelated to the refueling activity at hand. In the case of online merchants, the central system controller would conduct the proper electronic commerce activity as directed by the customer, namely by visiting the relevant Web site of the online merchant.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of delivering fuel to a vehicle positioned at a service station site, said service station site including a fuel dispensing assembly arranged to operatively provide fuel to said vehicle, said fuel dispensing assembly having a nozzle assembly, said method comprising the steps of:

providing a remote system controller disposed remote from said service station site;

generating at said service station site information relating to a refueling transaction request associated with said vehicle;

transmitting the generated information from said service station site to said remote system controller;

said remote system controller operatively performing the steps of processing the refueling transaction request associated with the information received from said service station site and generating control commands based on the processing activity for said refueling transaction request, said generated control commands being representative of a selectable refueling operation for said vehicle;

said fuel dispensing assembly placing the nozzle assembly of said fuel dispensing assembly into a selective one of engagement and disengagement with respect to a fuel inlet of said vehicle in accordance with the control commands generated by said remote system controller;

operating said fuel dispensing assembly in accordance with the control commands generated by said remote system controller to fuel said vehicle; and providing a communications network operatively connected to said remote system controller, said communications network being arranged to provide communications access to at least one merchant to enable the execution of a transaction therewith by said remote system controller in accordance with an associated transaction request operatively transmitted from said service station site to said remote system controller.

2. The method as recited in claim 1, further comprises the steps of:

generating at said service station site a commercial transaction request relating to commercial activity involving a selective one of said at least one merchant;

transmitting the generated commercial transaction request to said remote system controller; and said remote system controller performing the steps of processing the commercial transaction request transmitted thereto and conducting a transaction with the corresponding one of said at least one merchant associated with said commercial transaction request in accordance with the processing activity for said commercial transaction request.

3. The method as recited in claim 1, wherein the step of providing a communications network further includes the steps of:

providing an internet facility including a respective electronic commerce site for each one of said at least one merchant that enables the operative processing of transaction requests characterized by electronic commerce activity.

4. A method of delivering fuel to a vehicle positioned at a service station site, said service station site including a fuel dispensing assembly arranged to operatively provide fuel to said vehicle, said fuel dispensing assembly having a nozzle assembly, said method comprising the steps of:

providing an actuator assembly operatively associated with said fuel dispensing assembly, said actuator assembly being operative in response to suitable control commands applied thereto to controllably cause said nozzle assembly to be placed into a selective one of mating fueling engagement with the vehicle fuel inlet and disengagement from the vehicle fuel inlet;

providing a control assembly operatively connected to said fuel dispensing assembly and operatively connected to said actuator assembly;

wirelessly transmitting from said vehicle to said control assembly information relating to a refueling transaction request associated with said vehicle;

providing a remote operations facility disposed remote from said service station site;

transmitting from said control assembly to said remote operations facility the information wirelessly transmitted to said control assembly;

said remote operations facility performing the steps of processing the information received from said control assembly to make a refueling decision regarding a selective one of approval and denial of the refueling transaction request, generating control commands based on the information processing activity, and transmitting the generated control commands to said control assembly, said generated control commands being representative of a selectable refueling operation for said vehicle;

said control assembly operatively controlling the operation of said actuator assembly and the operation of said fuel dispensing assembly in accordance with the control commands received from said remote operations facility; and providing a communications network operatively connected to said remote operations facility, said communications network being arranged to provide communications access to at least one merchant to enable the execution of a transaction therewith by said remote operations facility in accordance with an associated transaction request operatively received from said control assembly.

5. The method as recited in claim 4, further comprises the steps of:

transmitting from said first wireless communications device to said second wireless communications device a commercial transaction request relating to commercial activity involving a selective one of said at least one merchant;

transmitting the commercial transaction request received by said second wireless communications device to said remote operations facility; and said remote operations facility performing the steps of processing the commercial transaction request transmitted thereto and conducting a transaction with the corresponding one of said at least one merchant associated with said commercial transaction request in accordance with the processing activity for said commercial transaction request.

6. The method as recited in claim 5, wherein the step of providing a communications network further includes the steps of:

providing an internet facility including a respective electronic commerce site for each one of said at least one merchant that enables the operative processing of transaction requests characterized by electronic commerce activity.

7. A method of handling a plurality of refueling transaction requests each associated with a respective one of a plurality of vehicles each positioned for refueling at an associated one of a plurality of service station sites, each one of said plurality of vehicles being operatively associated with a respective fuel dispensing assembly having a respective nozzle assembly and being arranged to operatively provide fuel to said vehicle associated therewith, said method comprising the steps of:

providing a remote operations facility disposed remote from at least one of said plurality of service station sites; and operatively performing in relation to each respective one of said plurality of refueling transaction requests the steps of:

generating at the associated service station site respective information relating to said respective one refueling transaction request, transmitting the respective generated information from said associated service station site to said remote operations facility, said remote operations facility operatively performing the steps of processing said respective one refueling transaction request by processing said respective information received from said associated service station site, and generating respective control commands based on the processing activity for said respective one refueling transaction request, said respective generated control commands being representative of a respective selectable refueling operation for said associated vehicle, said fuel dispenser assembly placing said respective nozzle assembly of said associated fuel dispensing assembly into a selective one of engagement and disengagement with respect to a fuel inlet of said associated vehicle in accordance with said respective control commands generated by said remote operations facility, operating said associated fuel dispensing assembly in accordance with said respective control commands generated by said remote operations facility; and providing a communications network operatively connected to said remote operations facility, said communications network being arranged to provide communications access to at least one merchant to enable the execution of a transaction therewith by said remote operations facility in accordance with an associated transaction request operatively received from a corresponding respective one of said plurality of service station sites in association with a corresponding respective one of said plurality of vehicles.

8. The method as recited in claim 7, further comprises the steps of:

generating at said corresponding respective one service station site a commercial transaction request relating to commercial activity involving a selective one of said at least one merchant;

transmitting the generated commercial transaction request to said remote operations facility; and said remote operations facility performing the steps of processing the commercial transaction request transmitted thereto and conducting a transaction with the corresponding one of said at least one merchant associated with said commercial transaction request in accordance with the processing activity for said commercial transaction request.

9. The method as recited in claim 8, wherein the step of providing a communications network further includes the steps of:

providing an internet facility including a respective electronic commerce site for each one of said at least one merchant that enables the operative processing of transaction requests characterized by electronic commerce activity.

10. A method of handling a plurality of refueling transaction requests each associated with a respective one of a plurality of vehicles each positioned for refueling at an associated one of a plurality of service station sites, each one of said plurality of vehicles being operatively associated with a respective fuel dispensing assembly having a respective nozzle assembly and being arranged to operatively provide fuel to said vehicle associated therewith, said method comprising the steps of:

providing a remote operations facility disposed remote from at least one of said plurality of service station sites; and operatively performing in relation to each respective one of said plurality of refueling transaction requests the steps of:

providing a respective actuator assembly operatively associated with said associated respective fuel dispensing assembly, said respective actuator assembly being operative in response to suitable control commands applied thereto to controllably cause said associated respective nozzle assembly to be placed into a selective one of mating fueling engagement with the fuel inlet of said associated vehicle and disengagement from the associated vehicle fuel inlet, providing a respective control assembly operatively connected to said associated respective fuel dispensing assembly and operatively connected to said respective actuator assembly, wirelessly transmitting from said associated vehicle to said respective control assembly respective information relating to said respective one refueling transaction request, transmitting from said respective control assembly to said remote operations facility the respective information wirelessly transmitted to said respective control assembly, said remote operations facility performing the steps of processing the respective information received from said respective control assembly to make a refueling decision regarding a selective one of approval and denial of said respective one refueling transaction request, generating respective control commands based on the respective information processing activity, and transmitting the respective generated control commands to said respective control assembly, said respective generated control commands being representative of a respective selectable refueling operation for said associated vehicle, said respective control assembly operatively controlling the operation of said respective actuator assembly and the operation of said associated respective fuel dispensing assembly in accordance with the respective control commands received from said remote operations facility, wherein each respective wireless information transmission step of each respective operative performance step associated with each respective one of said plurality of refueling transaction requests further comprises the steps of:

providing a respective first wireless communications device integral with said associated vehicle and having at least one of a transmit capability and a receive capability;

operatively activating said respective first wireless communications device to establish operative communications with said associated respective control assembly, said operative communications between said respective first wireless communications device and said associated respective control assembly including respective information relating to said respective one refueling transaction request, wherein each respective control assembly providing step of each respective operative performance step associated with each respective one of said plurality of refueling transaction requests, providing a respective second wireless communications device being disposed at said associated respective service station site in a manner sufficient to enable operative communications with said associated respective first wireless communications device while said associated vehicle is positioned for refueling relative to said associated respective fuel dispensing assembly; and providing a communications network operatively connected to said remote operations facility, said communications network being arranged to provide communications access to at least one merchant to enable the execution of a transaction therewith by said remote operations facility in accordance with an associated transaction request operatively received from a corresponding respective control assembly associated with a corresponding respective one of said plurality of vehicles.

11. The method as recited in claim 10, further comprises the steps of:

transmitting, from said respective first wireless communications device associated with said corresponding respective one control assembly to said respective second wireless communications device associated with said corresponding respective control assembly, a commercial transaction request relating to commercial activity involving a selective one of said at least one merchant;

transmitting to said remote operations facility the commercial transaction request received by said respective second wireless communications device associated with said corresponding respective control assembly; and said remote operations facility performing the steps of processing the commercial transaction request transmitted thereto and conducting a transaction with the corresponding one of said at least one merchant associated with said commercial transaction request in accordance with the processing activity for said commercial transaction request.

12. The method as recited in claim 11, wherein the step of providing a communications network further includes the steps of:

providing an internet facility including a respective electronic commerce site for each one of said at least one merchant that enables the operative processing of transaction requests characterized by electronic commerce activity.

* * * * *